US005499767A

United States Patent [19]

Morand

[11] Patent Number: 5,499,767

[45] Date of Patent: Mar. 19, 1996

[54] SHOWER HEAD HAVING ELONGATED ARM, PLURAL NOZZLES, AND PLURAL INLET LINES

[76] Inventor: Michel Morand, 4560 Hampton Street, Montreal, Quebec, Canada, H4A 2L4

[21] Appl. No.: 297,541

[22] Filed: Aug. 31, 1994

[30] Foreign Application Priority Data

Sep. 3, 1993 [GB] United Kingdom ..... 9318302

[51] Int. Cl.[6] ..... B05B 1/16; B05B 1/08

[52] U.S. Cl. ..... 239/383; 239/446; 239/449; 239/587.4

[58] Field of Search ..... 239/380, 381, 239/383, 436, 443–449, 587.1, 587.4; 4/601, 604

[56] References Cited

U.S. PATENT DOCUMENTS

| | | | |
|---|---|---|---|
| 1,758,115 | 5/1930 | Kelly . | |
| 2,228,626 | 1/1941 | Hetherington . | |
| 3,121,235 | 2/1964 | Gellmann . | |
| 3,801,019 | 4/1974 | Trenary et al. . | |
| 3,963,179 | 6/1976 | Tomaro . | |
| 3,998,390 | 12/1976 | Peterson et al. . | |
| 4,282,612 | 8/1981 | King | 4/601 |
| 4,397,050 | 8/1983 | Davis et al. . | |
| 4,398,668 | 8/1983 | Jette | 4/604 |
| 4,398,669 | 8/1983 | Fienhold . | |
| 4,629,125 | 12/1986 | Liu . | |
| 4,754,928 | 7/1988 | Rogers et al. . | |
| 4,796,815 | 1/1989 | Greenberg . | |
| 4,801,091 | 1/1989 | Sandvik | 239/381 |
| 4,901,927 | 2/1990 | Valdivia . | |
| 5,169,072 | 12/1992 | Gulyas | 239/381 |
| 5,220,697 | 6/1993 | Birchfield | 4/604 |
| 5,321,860 | 6/1994 | Steinhardt et al. | 4/601 |

FOREIGN PATENT DOCUMENTS

| | | | |
|---|---|---|---|
| 2595232 | 9/1987 | France | 4/601 |
| 6-22878 | 2/1994 | Japan | 4/601 |

*Primary Examiner*—Karen B. Merritt
*Attorney, Agent, or Firm*—Larson and Taylor

[57] ABSTRACT

An improved shower head having an elongated, rigid arm with a shower nozzle at one end of the arm and with the other end of the arm acting as a handle adapted to be grasped by the user. The arm is mounted, near its one end, by a swivel joint onto a shower pipe. The arm can be grasped by its handle end to move it about the swivel joint to position the shower nozzle. A control valve can be mounted on the arm to control the flow of water from the shower pipe to the shower nozzle. A second shower nozzle can be mounted on the other end of the handle and the control valve can control the flow of water to either the nozzle or to both simultaneously.

18 Claims, 8 Drawing Sheets

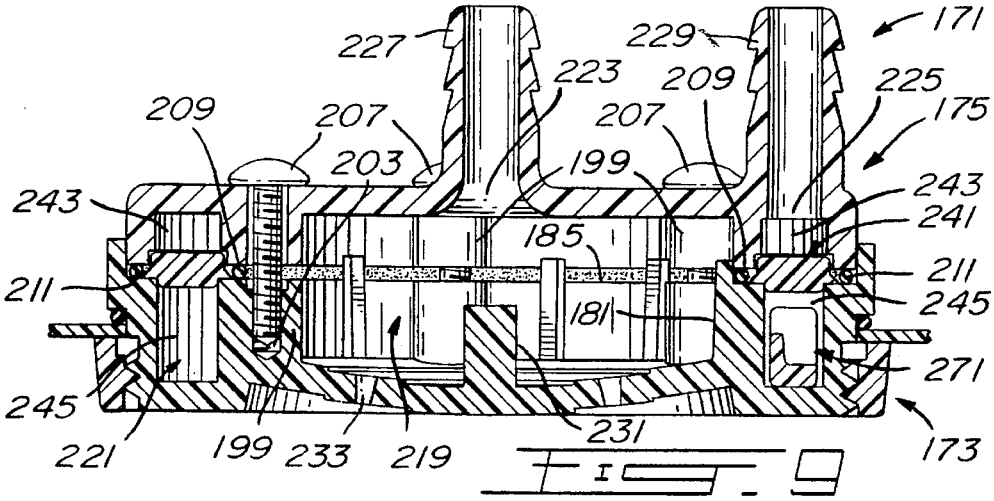
FIG. 9
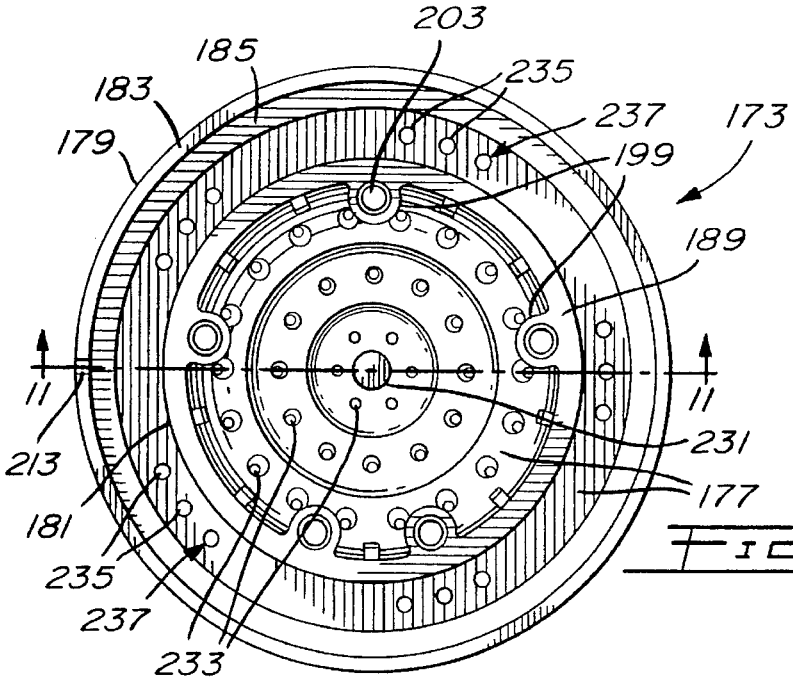
FIG. 10
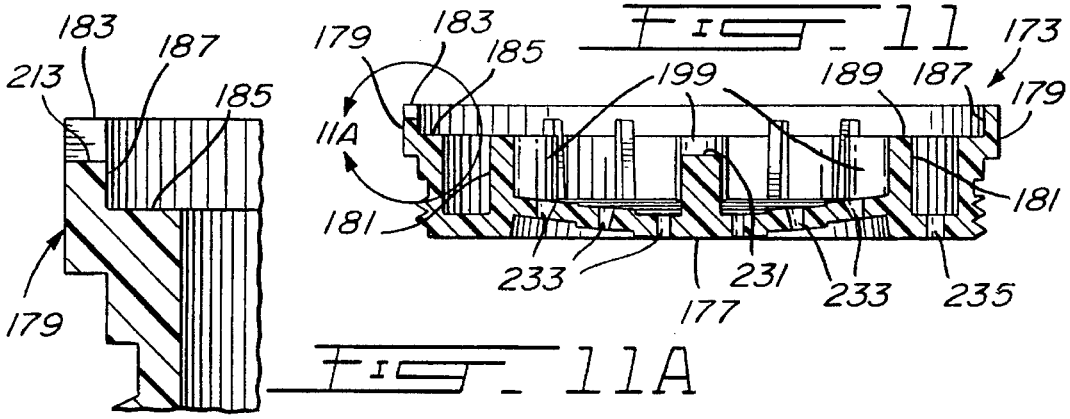
FIG. 11
FIG. 11A

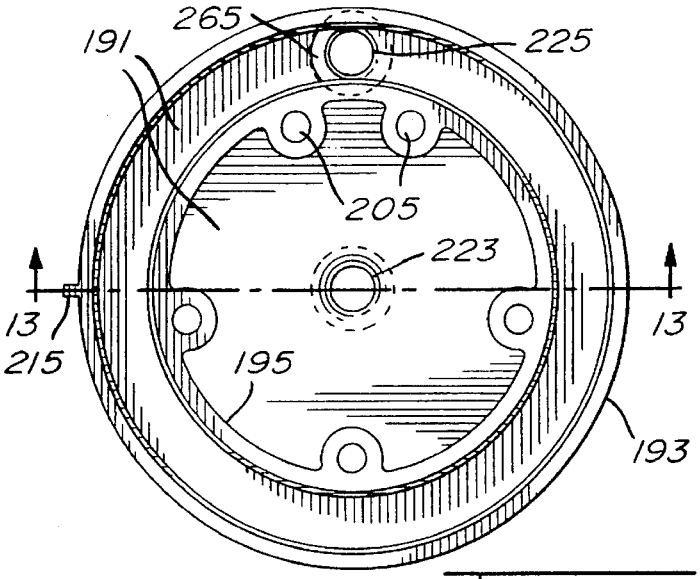
FIG. 12
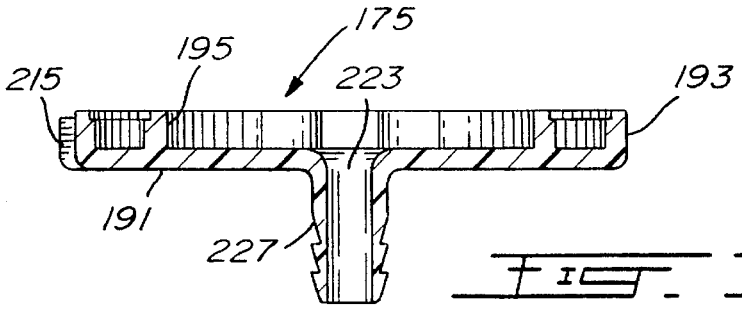
FIG. 13
FIG. 14
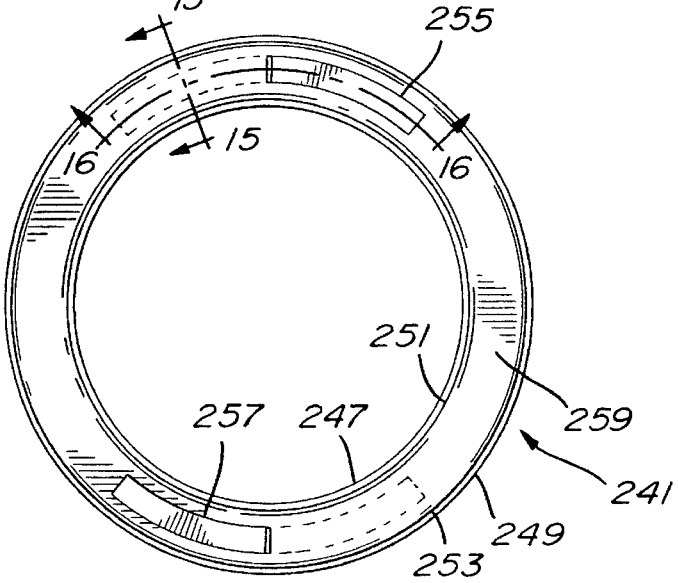

SHOWER HEAD HAVING ELONGATED ARM, PLURAL NOZZLES, AND PLURAL INLET LINES

The invention is also directed toward an improved, shower head.

The invention is also directed toward an improved, variable spray shower nozzle.

The invention is further directed toward an improved control valve, particularly for use in the shower head.

Shower heads are known that are swivel mounted on the end of the shower pipe in a shower stall or bathtub. The swivel mounting allows a person to adjust the angle of the shower spray. Unfortunately the shower head is up high and it is difficult, if not impossible, for a short person or a child to reach it to adjust the direction it sprays. High mounted shower heads make it difficult to get a forceful spray on the lower part of a persons body and also make it difficult, if not impossible, to wash only the lower part of a person's body. It is known to provide shower heads that have nozzles at different heights. Examples are shown in U.S. Pat. Nos. 1,758,115; 2,228,626; 3,121,235 and 4,397,050. With the nozzles at different heights children, as well as adults, can adjust at least some of the nozzles. However, either the nozzles have no individuals controls as shown in U.S. Pat. Nos. 3,121,235 and 4,397,050 making it difficult to wash only the lower part of a person's body, or an individual control is required for each nozzle as shown in U.S. Pat. Nos. 1,758,115 and 2,228,626 making them expensive.

It is also known to provide hand held shower heads that are connected to a water supply by a flexible hose. The hand held shower head allows a person to control the direction of spray, to obtain a forceful spray anywhere on the body, and to wash only the lower part of the body if desired. However, if the hand held shower head is mounted on the normal shower pipe, it is still too high for a child to reach. The hand held shower head can be mounted lower down in the shower while still connected to the shower pipe. Then however, there is the problem of providing a special mounting for it on the shower wall. Hand held shower heads also have the disadvantage of being awkward to use.

It is also known to provide variable spray shower nozzles. The type of spray desired from the nozzle can usually be selected by rotating an outer ring on the shower nozzle body. However again, because the shower nozzle is normally so high, it is difficult or impossible for a short person to reach the shower nozzle to adjust and/or select the spray. Variable spray shower nozzles could replace the nozzles shown in the above U.S. patents so that the nozzles would be accessible to young children. However these modified shower heads would still have the same disadvantages as previously pointed out with regard to their controls.

The known variable spray nozzles are also quite complicated in construction and thus relatively expensive. Because of their complicated construction they also are much more likely to fail than simple, fixed spray nozzles.

It is the purpose of the present invention to provide an improved shower head constructed so that the spray directed from its one or more nozzles can easily be controlled as to its direction by .an adult or a child. It is another purpose of the present invention to provide an improved shower head of the above type that does not require any special mounting, or tools, to install it. It is yet another purpose of the present invention to provide an improved shower head that has a control accessible by an adult, child or handicapped person. The control can be used to turn the spray on or off; to control the type of spray; or both. It is yet another purpose of the present invention to provide an improved shower head that has at least two vertically spaced apart shower nozzles with a single control easily accessible by an adult, child or handicapped person for turning the spray from the nozzles on or off individually or in combination. The single control could also be used to vary the spray from at least one of the nozzles.

It is a further purpose of the present invention to provide an improved shower nozzle of the variable spray type that allows the selection of the type of spray to be made at a location remote from the nozzle. It is another purpose of the present invention to provide an improved variable spray shower nozzle which is simple, inexpensive to manufacture and easy to operate. It is another purpose of the present invention to provide the above improved shower head with the improved variable spray nozzle.

It is a further purpose of the present invention to provide an improved control valve, particularly adapted for use in the shower head, which valve is compact in construction and simple in operation.

In accordance with the present invention, the improved shower head has an elongated, arm with a swivel mounting near its upper end. The swivel mounting is used to connect the arm to a shower pipe. At the front upper end of the arm there is an upper shower nozzle. A water pipe within the arm connects the swivel mounting to the nozzle. The lower end of the arm serves as a handle allowing the user to grasp the arm at its lower end and to move the arm about the swivel so as to position the nozzle to give the desired angle of spray. The arm is long enough to allow a child to grasp it to position the nozzle.

Preferably a control valve is provided in the arm near its lower end. Water lines in the arm carry water from the swivel joint to the nozzle via the control valve. The control valve is accessible from outside the arm near its lower end. Thus the flow of water from the nozzle can be easily controlled even by a child.

If desired a second lower shower nozzle can be provided at the lower end of the arm directing water downwardly. The control valve can be constructed to control the water flow to either the first or second nozzles or to both of them. The second nozzle provides a spray for a child since it is close to the child. The second spray can also be used by an adult to wash only the lower part of the body. An adult can also use both nozzles simultaneously to wash the entire body. The nozzles are preferably swivel mounted in the arm to allow for further adjustability of the spray.

The improved shower nozzle of the present invention has at least two different types of spray outlets with a separate water connection to each spray outlet. There is a separate water supply to each water connection. Selection of the appropriate water supply will determine which spray outlet is used. The water supply selection can be controlled by one or more control valves. The one or more control valves can be remotely located from the nozzle. The improved nozzle is particularly suited for use as the upper shower nozzle in the improved shower head since the accessible control valve on the arm of the shower head, remote from the nozzle, can be made to control which spray outlet in the nozzle is utilized depending on which water supply is connected to the nozzle by the valve.

The improved control valve has the water inlet and outlet openings stacked to make the valve compact. In addition, the outlet openings are arranged to make the valve compact.

The invention is particularly directed toward a shower head having an elongated arm. A shower nozzle is provided at one end of the arm. A swivel joint is provided on the arm near the one end for use in connecting the shower head to a shower pipe. There is a water line in the arm between the swivel joint and the nozzle for directing water from the shower pipe to the nozzle via the swivel joint when the shower head is connected to the shower pipe. The other end of the arm can be grasped and moved to position the nozzle when the shower head is connected to the shower pipe.

The invention is also directed toward a shower nozzle having a main body with at least two sets of spray openings on the body for spraying different patterns of water. The nozzle has a separate water inlet on the body for each set of spray openings.

The invention is further directed to an improved control valve having an outer casing and a valve member rotatably mounted within the casing. There is an inlet in the casing and three outlets with the outlets spaced axially from the inlet but aligned with each other. One outlet extends transversely from the casing in one direction with the other two outlets extending from the casing in opposite directions to the one outlet and parallel with the one outlet.

The invention will now be described in detail having reference to the accompanying drawings in which:

FIG. 9 is a cross-section view of the improved top shower nozzle;

FIG. 10 is a plan view of the base of the casing of the shower nozzle;

FIG. 11 is a cross-section view of the base taken along 11—11 in FIG. 10;

FIG. 11A is a detail view of the base showing the detail "A" in FIG. 11;

FIG. 12 is a bottom view of the cover of the casing of the top shower nozzle;

FIG. 13 is a cross-section view of the cover taken along line 13—13 in FIG. 12;

FIG. 14 is a plan view of the flow ring used in the nozzle;

Figure 1:
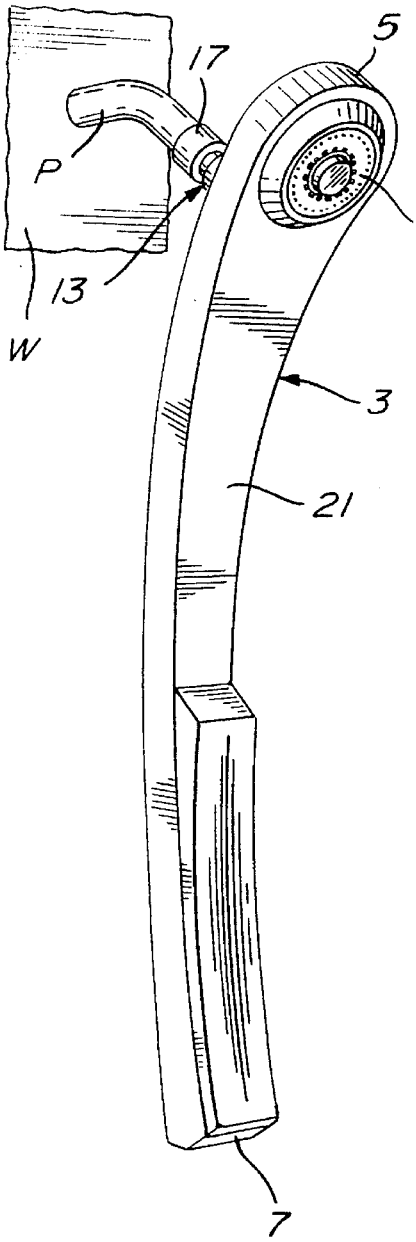
FIG. 1 is a perspective view of the shower head.
Figure 2:
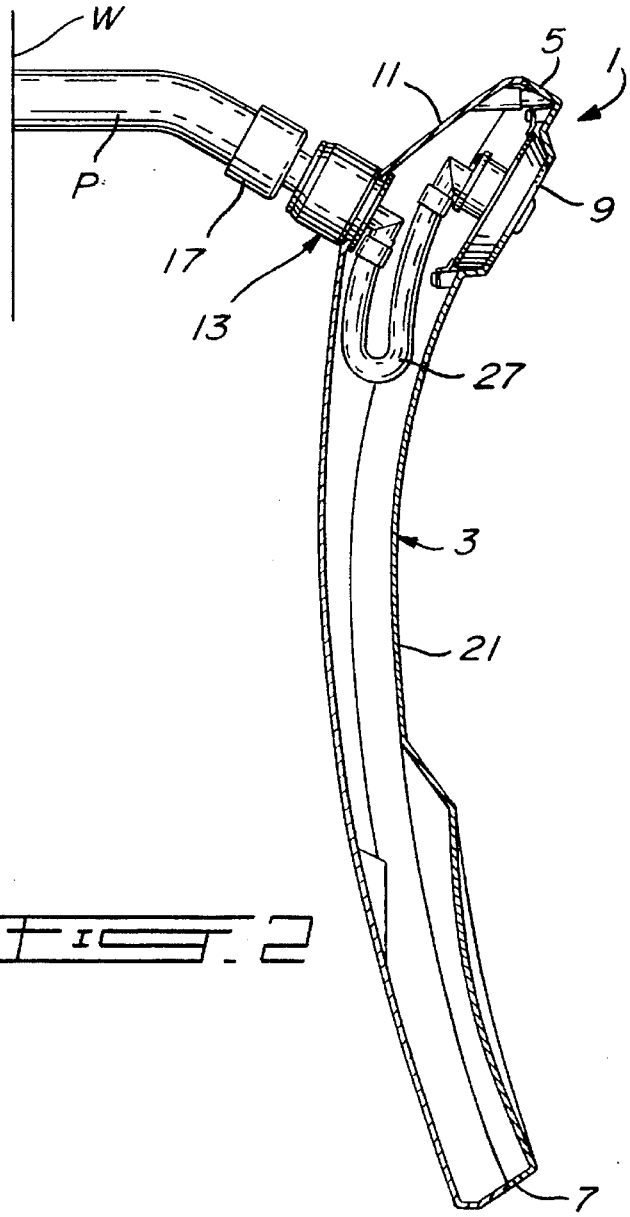
FIG. 2 is a vertical cross section view of the shower head.

The shower head 1 of the present invention, as shown in FIGS. 1 and 2, has an elongated, arm 3. The arm 3 is curved from its top end 5 to its bottom end 7 and is slightly enlarged at its top end 5 to hold a shower nozzle 9 as will be described.

The back 11 of the arm 3 carries a swivel joint 13 near its top end 5 by means of which the shower head 1 is connected to a shower pipe "p" in a shower or bath tub. The shower pipe "p" extends through the shower wall "w". The swivel joint 13 is preferably a ball joint and has a through passageway (not shown) for carrying water from the shower pipe "p" into the arm. The swivel joint 13 has a threaded connector 17 at one end for connecting it to the shower pipe "p" as is well known. The swivel joint 13 can have a tightening device (not shown) adapted to vary the friction of the swivel joint 13 and control the positioning of the arm.

A regular shower nozzle 9 is mounted in the front 21 of the arm 3 adjacent its top end 5. The shower nozzle 9 is preferably located between the joint 13 and the top end 5 of the arm 3. With the ends 5, 7, of arm 3 curved away from the swivel joint 13, the shower nozzle 9 is normally angled downwardly as shown in FIG. 2. Preferably the nozzle 9 is swivel mounted in the arm.

In the simplest form of the invention there is direct water connection means between the swivel joint 13 and the shower nozzle 9. The direct water connection means comprises a water line 27 within the arm 3 connected between the joint 13 and the nozzle 9. The shower can be turned on by normal shower controls (not shown) located on the shower wall "w". The spray from the nozzle 9 can be directed by grasping the arm 3 near its lower end 7 and pivoting and/or tilting the arm 3 about the swivel joint 13. The elongated arm 3 permits a child to easily direct the spray from the nozzle 9.

Figure 3:
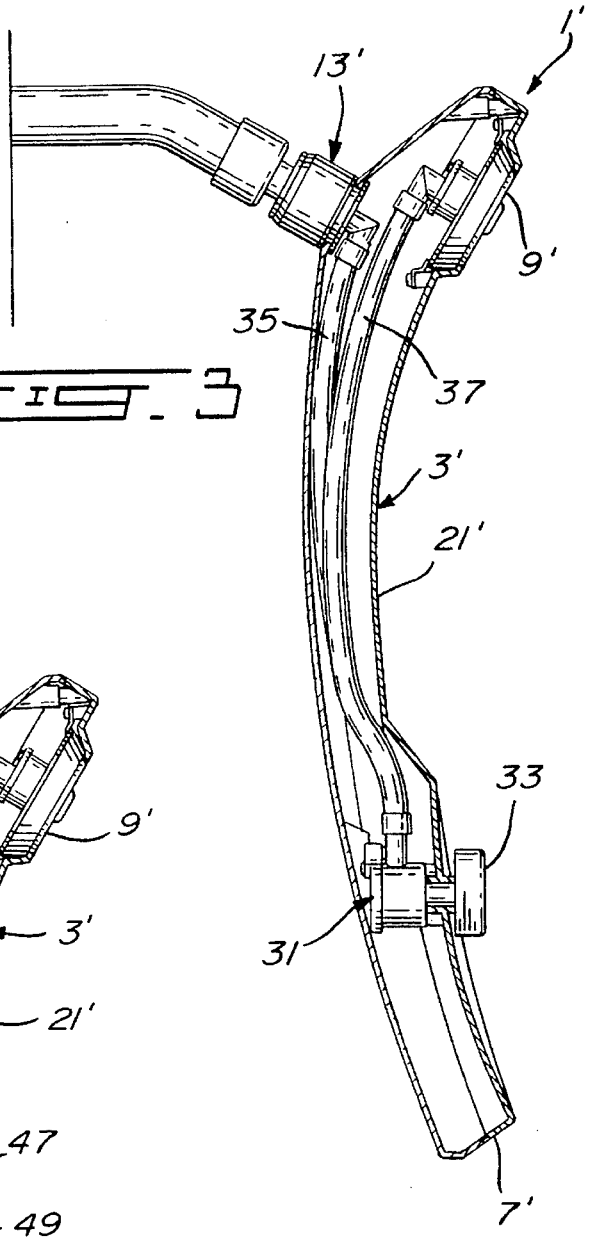
FIG. 3 is a vertical cross section view of a modified shower head with a control valve.

In a more elaborate embodiment of the invention, the shower head 1' can be provided with a control valve 31 directly in the arm 3'. As shown in FIG. 3, the control valve 31 is provided near the bottom end 7' of the arm 3' with its handle 33 on the front 21' of the arm. In this embodiment the water connection means comprises a first, water line 35 leading from the swivel joint 13' to the control valve 31 within the arm 3' and a second, water line 37 leading from the control valve 31 to the nozzle 9'. The control valve 31 on the lower end of the arm 3' is readily accessible to a child or adult using the shower. The control valve in this embodiment is a simple on-off valve.

Figure 4:
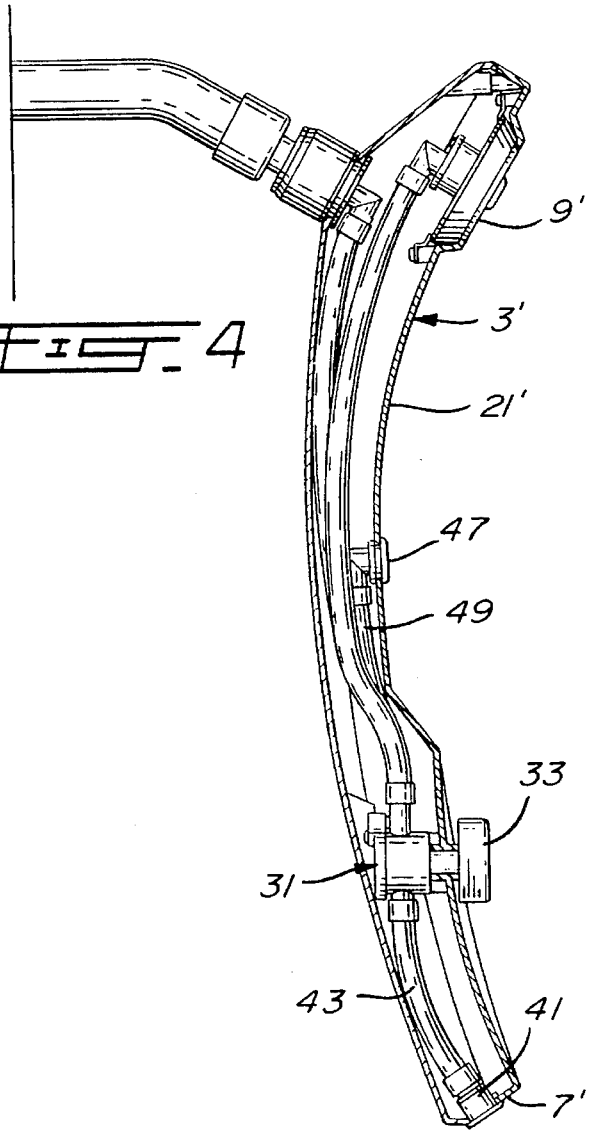
FIG. 4 is a vertical cross section view of a further modified shower head.

Preferably the shower head 1' is provided with a second shower nozzle 41 located at the bottom end 7' of the arm 3' as shown in FIG. 4. The second nozzle 41 is positioned at the bottom end 7' of the arm 3' and preferably directs a spray of water downwardly from the shower head 1'. The second nozzle 41 can also be swivel mounted in the arm 3'. This second nozzle 41 is connected to the control valve 31 by a third, water line 43 leading from the control valve 31 to the second nozzle 41 within the arm 3'. The control valve 31 in this embodiment can be of the type that can be selected to send water to the first upper nozzle 9' only, to the second lower nozzle 41 only, to both nozzles 9', 41 simultaneously or to neither nozzle. The second shower nozzle 41 permits a child to be closer to the spray before it fans out. The second shower nozzle 41 also permits an adult to wash only the lower part of their body, if desired, or to simultaneously direct water onto the upper and lower parts of their body when showering.

Figure 5:
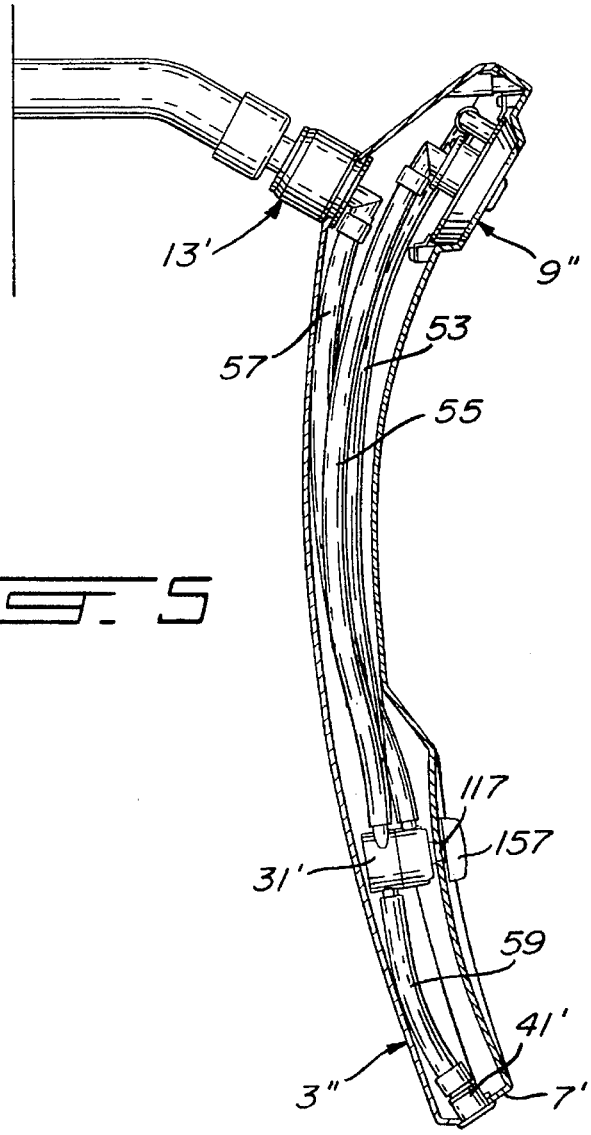
FIG. 5 is a vertical cross section view of an improved upper shower head with an improved shower nozzle.

In a preferred form of the invention, the shower head can be provided with at least the first upper nozzle being of the variable spray type. The variable spray first nozzle is however different from known variable spray nozzles in that it is provided with at least two sets of spray openings, one set providing one type of spray, the other set providing another type of spray. Each set of spray openings is provided with its own supply of water via a separate line leading from the control valve. As shown in FIG. 5, the variable spray nozzle 9" in the arm 3", with two sets of different spray openings (not shown), has two water lines 53, 55 leading to it from the control valve 31'. One water line 53 supplies water to one set of spray openings, the other water line 55 supplies water to the other set of spray openings. The control valve 31' receives water from the shower pipe via line 57 and can direct water to a bottom nozzle 41' via line 59. The control valve 31' is of the type that can provide water to none of the outlet water lines, to each outlet water line 53, 55, 59 alone or to any outlet water line in combination with one or more of the other lines.

While all the embodiments described above have the control valve able to shut off the flow to all the outlets in the shower head, the control valve could also be of the type that always leaves at least one outlet open. With this second type of control valve, the water supply to the shower head would be shut off by the normal shower controls located on the shower wall.

Figure 6:
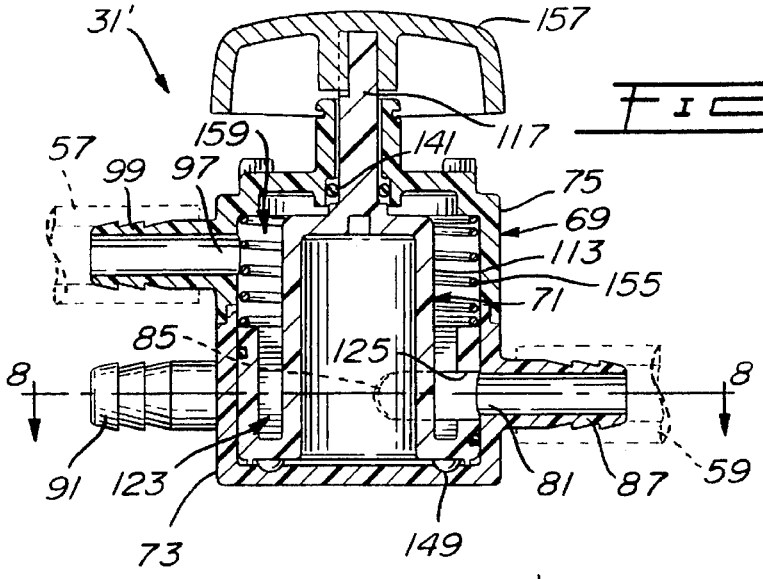
FIG. 6 is a cross section view of a control valve.
Figures 7, 7A, 7B:
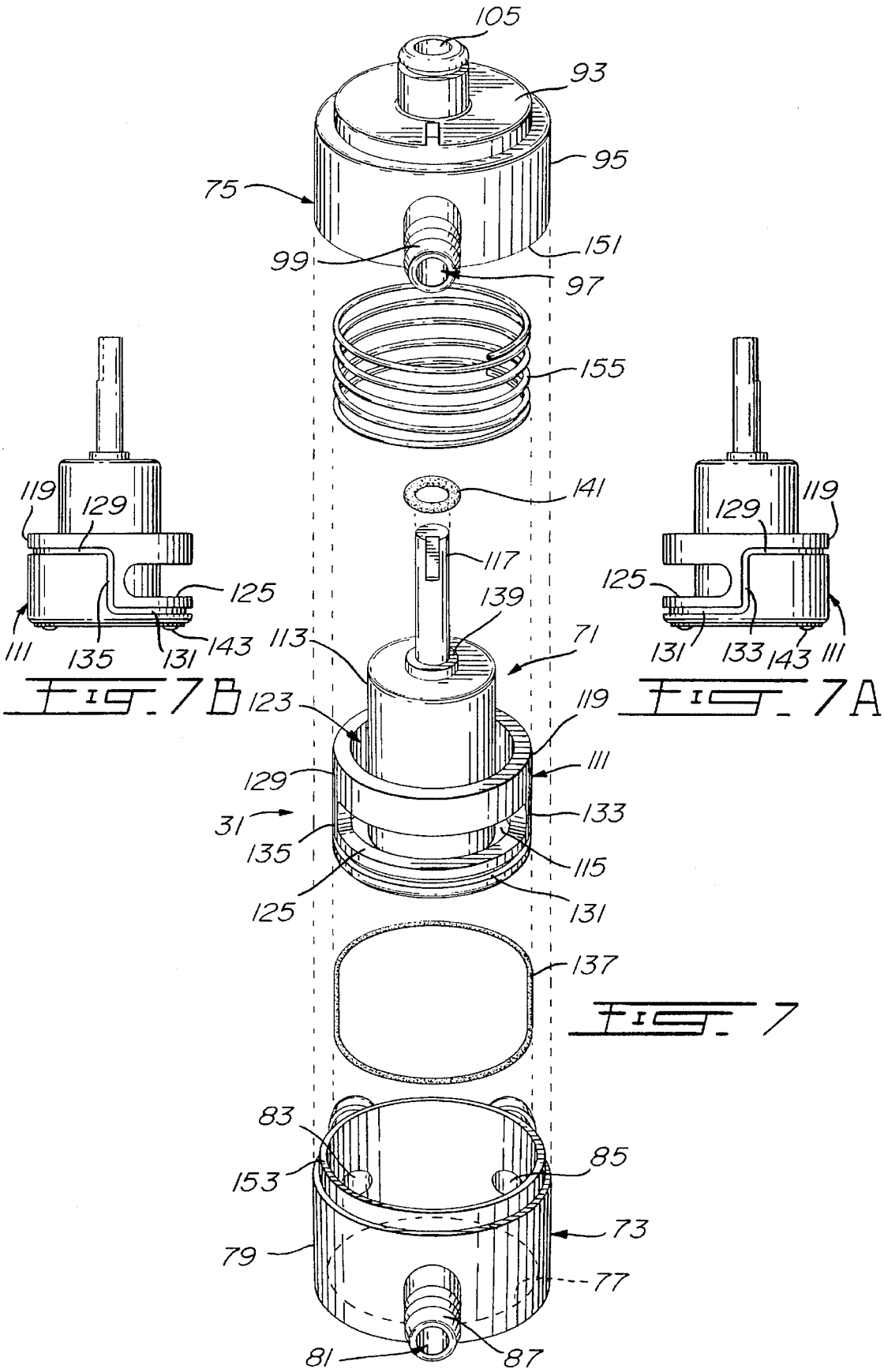
FIG. 7 is an exploded view,.partly broken away, of the control valve.
FIG. 7A is a left side view of the valve base.
FIG. 7B is a right side view of the valve base.

A suitable control valve 31' of the second type is shown in FIGS. 6 to 8. The control valve 31' has a casing 69 and a valve member 71 rotatable within the casing. The casing 69 is cylindrical and is made in two parts, a base part 73 and a cap part 75 as shown in FIG. 6. The base part 73 is cup-shaped having a circular end wall 77 and a cylindrical side wall 79 extending from the circular edge of the end wall 77 as shown in FIG. 7. There is a bottom outlet opening 81 in the side wall 79 and two, top outlet openings 83, 85 in the side wall 79. The openings 81, 83 and 85 are all located the same distance from the end wall 77. The bottom outlet opening 81 extends radially and a fitting 87, as shown in FIG. 8A, extending radially outwardly from the side wall 79, is used to connect the opening 81 to a water line as will be described. The top outlet openings 83, 85 extend parallel to the fitting 87. Fittings 89 and 91 extend outwardly from the side wall 79, parallel to, but in opposite directions to the fitting 87 as shown in FIG. 8A. The fittings 89, 91 are used to connect the openings 83, 85 to water lines as will be described. The openings 83, 85 are about one hundred degrees apart and are each located about one hundred and thirty degrees from the opening 81. The fittings 87, 89 and 91 can be integral with the base part 73. The parallel and opposed arrangement of the outlet fittings provides a compact control valve which can fit in a narrow space such as the lower end of the shower arm.

The cap part 75 of the casing 69 is also cup-shaped having a circular end wall 93 and a cylindrical side wall 95 extending from the circular edge of the end wall 93 as shown in FIG. 7. The side wall 95 is the same diameter as the side wall 79 in the base part 73 and is also the same thickness. An inlet opening 97 is provided in the side wall 95. The inlet opening extends radially, and a fitting 99, extending radially from the side wall 95, connects the opening to a water line as will be described. The fitting 99 can be integral with the cap part 75. A valve member opening 105 is provided in the center of the end wall 93.

The valve member 71 has a cup-shaped, cylindrical base 111 and a cylindrical stem 113 as shown in FIG. 7. The stem 113 is centrally located on the bottom wall 115 of the base 111 and projects outwardly from the base. The upper, free end of the stem 113 is stepped down to provide a mounting pin 117. The outer diameter of the stem 113 is smaller than the inner diameter of the side wall 119 of the base 111 so as to form an annular channel 123 between the side wall 119 and the stem. An elongated slot 125 is formed in the side wall 119 of the base 111. The slot 125 extends about one hundred and sixty degrees in the circumferential direction of the side wall.

Sealing means are provided on the valve member 71. The sealing means, as shown in FIGS. 7A, 7B, can include a part circumferential sealing groove 129 located above and behind the slot 125; a part circumferential sealing groove 131 located below and in front of the slot; and two longitudinal sealing grooves 133, 135, one adjacent one end of the slot and the other adjacent the other end of the slot. The longitudinal sealing grooves 133, 135 join the ends of the part circumferential grooves 129, 131 together. The part circumferential grooves 129, 131 and the longitudinal grooves 133, 135 are formed in the outer surface of the side wall 119 of the base 111 as shown in FIGS. 7A, 7B. A sealing member 137 in the form of an elastomeric O-ring or loop fits in the grooves 129 to 135 to seal off the slot 125 as will be described. The sealing member 137 is sized to fit in the longitudinal grooves 133, 135, the portion of the circumferential groove 131 under the slot 125 and the portion of the circumferential groove 129 away from the slot. A circumferential seat 139 is also provided on the mounting pin portion 117 of the stem 113 for receiving an O-ring sealing member 141.

Means, such as detent means, can be provided on the valve to positively locate the valve in its different operating positions. The detent means can comprise a plurality of raised knobs 143 extending downwardly from the bottom 111 and are held in close contact with the end wall 77 by the compression spring 155. A plurality of circumferentially spaced apart detents 149 are formed in the inner surface of the end wall 77 of the base part 73 of the casing 69 as shown in FIG. 6. Each detent 149 is at a particular valve position. When the valve is being moved to any one particular valve position, the raised hemispherical knobs 143 snap into the detent 149 at that position to let the operator know that the one particular valve position has been reached.

The control valve 31' is assembled by sliding the base 111 of the valve member 71 into the cup-shaped base part 73 of the casing 69 so that the bottom wall 115 of the base 111 abuts the end wall 77 of the base part 73 as shown in FIGS. 6 and 7. In this position, the slot 125 in the base 111 is aligned longitudinally with the openings 81, 83 and 85 in the base part 73. The base 111 of the valve member 71, with the sealing member 137 mounted on it, fits snugly within the base part. The cap part 75 of the casing is then mounted over the valve member 71 with the free end 151 of its side wall 95 abutting the free end 153 of the side wall 79 of the base part 73. The mounting pin portion 117 of the stem 113 of the valve member 71 passes through the opening 105 in the end wall 93 of the cap part 75. The O-ring member 141 seals the opening 105. Suitable means, not shown, may be used to retain the base and cap parts 73, 75 in assembled relationship about the valve member 71. A compression spring 155 is provided within the casing 69 located between the end wall 93 of the cap part 75 of the casing 69 and the top of the side wall 119 of the base 111. When the valve is assembled, the inlet fitting 99 is stacked over the outlet fittings 87, 89 and 91 providing a compact valve which can fit in a shallow space such as the lower end of the shower arm.

Figure 8A:
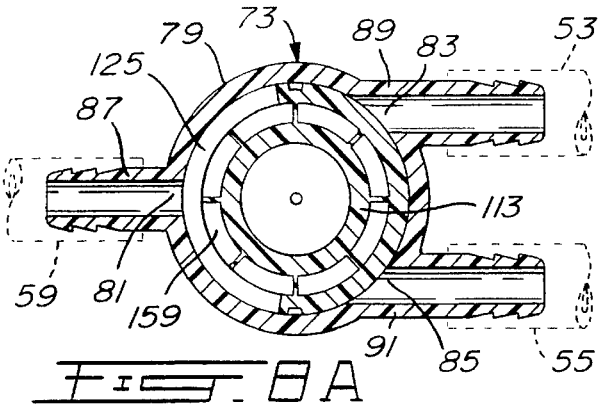
FIGS. 8A to 8D are cross-section views of the control valve taken along line 8—8 in FIG. 6 showing the control valve in various positions.

The assembled control valve 31' is mounted within the lower end of the shower head as shown in FIG. 5 with the mounting pin portion 117 of the stem 113 passing out through an opening in the front wall of the shower nozzle. A handle 157 is attached to the pin portion 117 by suitable means, not shown. The two water lines 53, 55 leading from the variable spray nozzle 9" are connected to the valve 31' at the openings 83, 85 in the base part 73 by the fittings 89, 91 as shown in FIG. 8A. The water line 59 leading from the bottom nozzle 41' is connected to the valve 31' at the bottom outlet opening 81 by the fitting 87. The water line 57 from the shower pipe is connected to the valve 31' at the inlet opening 97 in the cap part 75 by the fitting 99 as shown in FIG. 6.

The assembled control valve 31' permits water to flow into the valve through the inlet opening 97, through the valve in the annular channel 159 formed between the stem 113 and the cap part 75 of the casing, and through the annular channel 123 in the valve member 71 which forms an extension of the annular channel 159. Water leaves the valve 31' through the slot 125 and through any one or two of the outlet openings 81, 83 and 85 depending on the position of the handle 157. It will be seen that the water flows radially into the valve, longitudinally along its length through the annular channels 159, 123, and radially out the valve. The specific construction of the sealing member 137 seals the slot 125 from the outlets the slot is not aligned with, thereby preventing leaking through those outlets.

In operation, the handle 157 can be rotated to rotate the valve member 71 within the casing 69 so that the slot 125 is aligned with the outlet opening 81 only as shown in FIG. 8A (9 o'clock position). The base 111 of the valve member and the sealing member 137 closes off the outlet openings 83, 85 from the slot 125. In this position, water flows through the line 59 and out of the bottom nozzle 41' only.

Figure 8B:
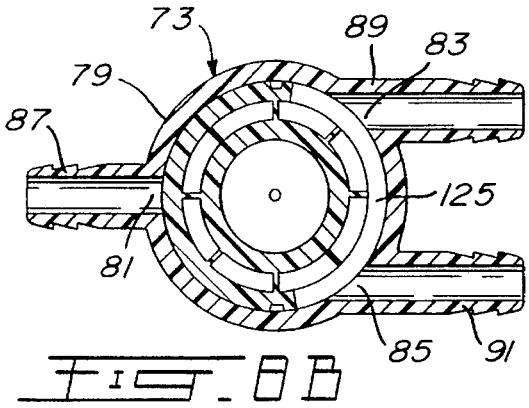
Figure 8C:
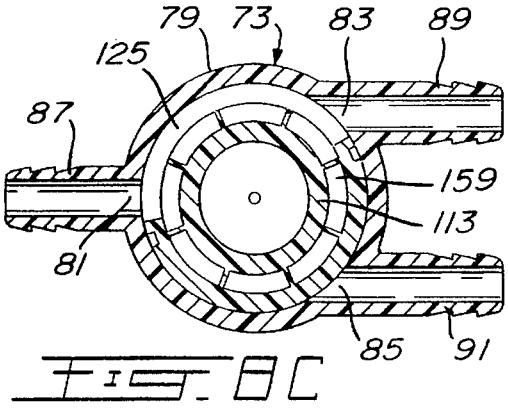

In a further position, the handle 157 can be rotated to position the slot 125 opposite both the outlet openings 81, 83 as shown in FIG. 8C (11 o'clock position). In this position water flows both to the bottom nozzle 41' through the line 59 and to one set of spray nozzles in the upper variable spray nozzle 9" through line 53 providing one type of spray.

If the valve member 71 is rotated just slightly clockwise from the position shown in FIG. 8C to move the slot 125 past the opening 81 (1 o'clock position), then water flows only out of the opening 83 and one set of spray nozzles in the variable spray nozzle 9".

In another position the handle 157 can be rotated to position the slot 125 opposite both the outlet openings 83, 85 as shown in FIG. 8B (3 o'clock position). In this position the base 111 and the sealing member 137 close off the outlet opening 81, and water flows out of both sets of spray openings in the variable spray nozzle 9" through lines 53, 55.

If the valve member 71 is rotated just slightly clockwise from the position shown in FIG. 8B to move the slot 125 past the opening 83 (5 o'clock position), then the water flows only out of opening 85 through line 55 and the other set of spray nozzles in the variable spray nozzle 9".

Figure 8D:
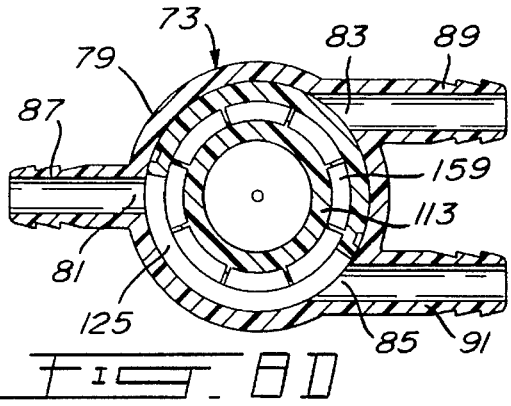

In yet another position, the handle can be rotated to position the slot 125 opposite both the outlet openings 81, 85 as shown in FIG. 8D (7 o'clock position). In this position water flows both to the bottom nozzle 41' through the line 59 and to the other set of spray nozzles in the variable spray nozzle 9" through line 55 providing another type of spray.

It is thus seen that the control valve 31' can be used to provide various types of single or combination sprays from one or both of the two nozzles 41' and 9" in the shower head.

The preferred shower nozzle 9", as shown in FIGS. 9 to 18 has a generally thin, cylindrical shaped casing 171. The casing 171, as shown in FIG. 9, is made in two parts, a base 173 and a cover 175. The base 173 of the casing 171, as shown in FIGS. 10 and 11, has a circular end wall 177 and an outer side wall 179 extending transversely from the circular edge of the end wall 177. The base also has an inner side wall 181, concentric with the outer side wall 179, and extending transversely from the end wall 177. The outer side wall 179 of the base 173 is slightly higher than the inner side wall 181. The outer side wall 179 is stepped on its inner side adjacent its free end 183 forming an inner shoulder 185 and an outer flange 187 as shown in FIG. 11A. The inner shoulder 185 is the same distance from the end wall 177 as the free end 189 of the inner side wall 181.

The cover 175, as shown in FIGS. 12 and 13, has a circular end wall 191 and an outer side wall 193 extending transversely from the circular edge of the end wall 191. The cover has an inner side wall 195, concentric with the outer side wall 193 and extending transversely from the end wall 191. The inner side wall 195 of the cover 175 has the same mean diameter as the inner side wall 181 of the base 173. The outer side wall 193 of the cover 175 has the same mean diameter as the inner shoulder 185 on the outer side wall 179 of the base 173.

The base 173 has a number of spaced apart bosses 199 on the inner surface of its inner side wall 181. The bosses 199 extend parallel to the longitudinal axis of the base 173 and each boss 199 has a tapped hole 203. The cover 175 has a number of spaced apart holes 205 in its end wall 191 arranged in a circle just inside its inner side wall 195.

The casing 171 is assembled by closing the base 173 with the cover 175. When the cover 175 is in the proper position, the holes 205 in it are aligned with the tapped holes 203 in the base 173. Screws 207, as shown in FIG. 9, are passed through the holes 205 in the cover 175 and into the threaded holes 203 in the base 173 to securely attach the cover to the base. When the cover is connected to the base, its inner side wall 195 is aligned with the inner side wall 181 of the base and its outer side wall 193 is within the flange 187 and aligned with the shoulder 185. An O-ring 209 is located between the free ends of the inner side walls 181 and 195 and another O-ring 211 located between the outer side wall 193 and the shoulder 185 to seal the casing 171. To ensure that the cover 175 is in the proper position when securing it to the base 173, a locating notch 213 is provided in the flange 187 of the base 173 as shown in FIG. 11A. A locating rib 215 on the outer surface of the outer wall 193 of the cover 175 fits in the notch 213 to ensure that the cover 175 is properly aligned with the base 173.

When the casing 171 is assembled, an inner, cylindrical chamber 219 is formed within the casing within the inner side walls 181, 195 of the base and cover respectively, and an outer, annular chamber 221 is formed between the inner side walls 181, 195 and the outer side walls 179, 193 of the base and cover respectively.

The casing 171 has water inlet means to both chambers 219, 221. The water inlet means to the inner chamber 219 comprises a first, relatively large, inlet hole 223 in the center of the end wall 191 of the cover 175 of the casing 171. The water inlet means to chamber 221 comprises a second, relatively large, inlet hole 225 in the end wall 191 of the cover 175 located between the inner and outer side walls 195 and 193. Hose end fittings 227, 229 are formed on the outer surface of the end wall 191 of the cover 175 aligned with the inlet holes 223, 225 respectively. Preferably a diffuser 231 in the form of a short, cylindrical pin is provided in the center of the end wall of the base 173. The diffuser 231 faces the inlet opening 223 and diffuses water entering the inner chamber 219.

The casing 171 has water outlet means from both chambers 219, 221. The water outlet means from the inner chamber 219 comprises a first plurality of small openings 233, generally equally spaced apart, in the end wall 177 of the base 173 within the inner wall 181. These first openings 233 provide one type of spray. The water outlet means from the outer, annular chamber 221 comprises a second plurality of small openings 235 in the end wall 177 of the base 173 between the inner side wall 181 and the outer side wall 179. These openings 235 are arranged in equally spaced apart sets or groups 237 in a circle with openings in each group also being equally spaced apart. These second openings 235 provide another type of spray.

Figure 15:
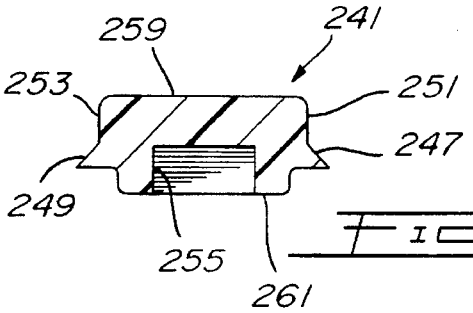
FIG. 15 is a cross-section view of the flow ring taken along line 15—15 in FIG. 14.
Figure 16:
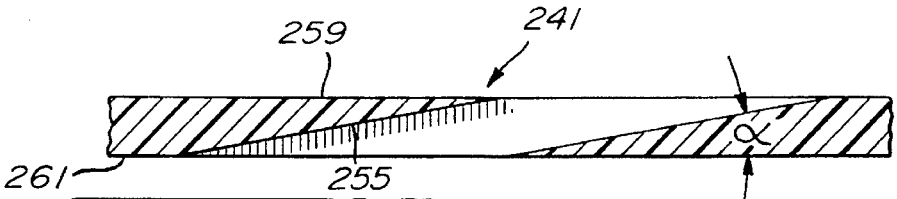
FIG. 16 is a detail cross-section view of the flow ring taken along line 16—16 in FIG. 14.

Means are provided for pulsing the water flow through the openings 235 from the outer annular chamber 221. The pulsing means can have a water flow directing ring 241 located within the outer chamber 221 and dividing the outer chamber into an inlet chamber 243 and an outlet chamber 245. The flow ring 241, as shown in FIGS. 14 to 16, has a rectangular cross-section and has flanges 247, 249 projecting from its sides 251, 253. The flow ring 241 is clamped between the base 173 and the cover 175 of the casing 171 when they are assembled, the flanges 247, 249 resting on the free end 189 of the inner side wall 181 and on the shoulder 185 of the outer side wall 179 of the base. The flow ring 241 projects slightly into both the inlet and outlet chambers 243, 245.

The flow ring 241 has two diametrically opposed, slanted passages 255, 257 therein. Each slanted passage extends through the ring 241 from its top side 259 to its lower side 261. The passages 255, 257 extend at a relatively shallow angle through the ring and each passage extends over about 80° of the ring. The angle is preferably around 10° . The passages 255, 257 direct water from the inlet chamber 243 to the outlet chamber 245, the water entering the outlet chamber 245 from two diametrically opposed locations at a relatively shallow angle and in a generally circular direction as viewed in FIG. 16. Preferably, the water entering the inlet chamber 243 from the inlet opening 225 is directed in a direction so as to smoothly flow through the passages 255, 257 in the flow ring 241. To direct the water in a circular direction, a wall 265 projects down from the end wall 191 of the cover 175 adjacent the inlet opening 225 into the inlet chamber 243 to prevent the water from flowing backwards within the inlet chamber.

Figure 17:
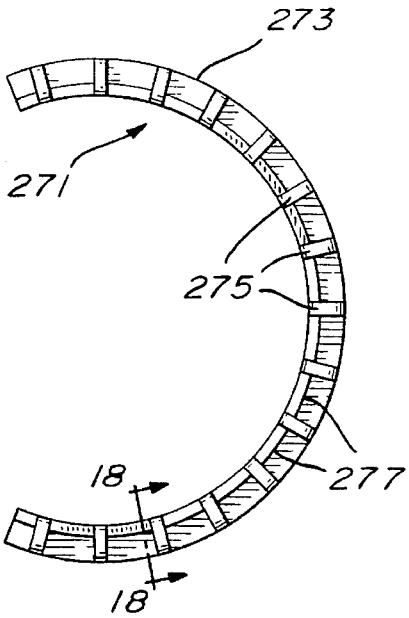
FIG. 17 is a plan view of the spinner used in the nozzle.
Figure 18:
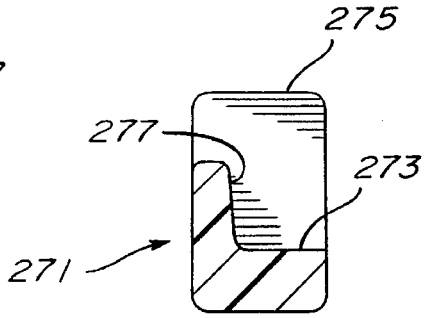
FIG. 18 is a cross-section view of the spinner taken along line 18—18 in FIG. 17.

A spinner 271 is mounted within the outlet chamber 245 as the casing 171 is assembled. The spinner 271, as shown in FIGS. 17 and 18, has a flat base 273 in the form of an annular section that extends through an arc of about 225° . A set of spaced-apart vanes 275 extend up from the base 273. A rib 277 can be provided on the inner side of the base 273, between the vanes 275 to strengthen the spinner. The spinner is rotated within the outlet chamber 245, by water emerging from the passages 255, 257 and impinging on the vanes 275. As the spinner rotates within the outlet chamber 245, it covers and uncovers the sets 237 of openings 235 so that water emerges from the openings 235 in brief pulses.

The control valve 31' is attached to the shower nozzle 9" by a line 55 leading from fitting 91 on valve 31' to the first fitting 227 on the cover 175 of the shower nozzle 9" and with line 53 leading from fitting 89 on valve 31' to the second fitting 229 on the cover 175 of the shower nozzle 9". When valve 31' is operated to send water to the shower nozzle through the line 55, the water enters the cylindrical, inner chamber 219 through the central opening 223 in the cover 175 and impinges on the end of the diffuser 231 to diffuse throughout the chamber 219. The diffused water exits from the chamber through the first opening 233 in a generally uniform, evenly distributed spray to provide one type of spray.

When valve 31' is operated to send water to the shower nozzle 9" through the line 53, the water enters the outer, annular inlet chamber 243 through the opening 225 in the cover 175, and directed by the wall 265, moves in a counterclockwise direction within the chamber 243. The water in the inlet chamber 243 moves through the passages 255, 257 into the outlet chamber 245, striking the vanes 275 on the spinner 271 and causing it to rotate within the outlet chamber 245. The rotating spinner 271 allows the water to leave the outlet chamber 245 through the second openings 235 in pulsating bursts to provide another type of spray. As previously described, the valve 31' can also be operated to send water to the shower nozzle through both lines 53, 55 to provide both types of sprays simultaneously.

In addition the valve 31' can be operated to send water to the bottom nozzle 41' through line 59 and as has been described in detail above, the water can also be directed to the bottom nozzle in combination with one of the sprays in the upper variable spray nozzle 9".

The shower nozzle described above is quite simple in construction and effective in operation. The shower nozzle described had two sets of spray openings. The nozzle could however have more than two sets of spray openings. The only limitation is that each set of spray openings has its own water supply line and that there are control means for each line.

In another embodiment of the invention, the shower head 1' can include a third shower nozzle 47 in the arm 3' located at about the middle of the front of the arm as shown in FIG. 4. This third nozzle 47 directs water laterally outwardly from the shower head and can be swivel mounted in the arm 3'. The third nozzle is, as with the other nozzles, connected by a water line 49 to the control valve 31. The control valve can be constructed to use the third nozzle in combination with either or both of the first and second nozzles 9', 41. The third nozzle 47 provide additional flexibility in showering.

The shower head can be equipped with auxiliary services such as a radio, a clock or a light. There is room within the arm to mount such devices making them easily accessible to the user. The arm can also be provided with soap and/or shampoo dispensers which can feed directly to the water line if desired. A small electric generator can be provided in the main water supply line within the arm to provide electricity for any electrical devices mounted on the arm.

I claim:

1. A shower head having: an elongated, rigid arm having a front and a back; a shower nozzle provided at one end of the arm, the shower nozzle being at the front of the arm; a swivel joint provided on the arm near the one end of the arm for use in connecting the shower head to a shower pipe, the swivel joint being at the back of the arm; water connection means in the arm between the swivel joint and the shower nozzle for directing water from the shower pipe to the nozzle via the water connection means when the shower head is connected to the shower pipe; the other end of the arm adapted to be manually moved to position the nozzle when the shower head is connected to the shower pipe.

2. A shower head as claimed in claim 1 wherein both ends of the arm are curved away from the swivel joint.

3. A shower head as claimed in claim 1 including a control valve on the arm, the water connection means leading from the swivel joint to the shower nozzle passing through the control valve.

4. A shower head as claimed in claim 3 wherein the shower nozzle is a first shower nozzle and the water connection means includes a first line leading from the control valve to the first shower nozzle, a second shower nozzle at the other end of the arm, the second nozzle normally directing water downwardly when the shower head is connected to the shower pipe, and the water connection means including a second line leading from the control valve to the second nozzle, the control valve constructed to selectively direct water to the first nozzle only, the second nozzle only, or to both nozzles simultaneously.

5. A shower head as claimed in claim 4 including a third shower nozzle at the front of the arm about midway between the first and second nozzles and the water connection means including a third line connecting the control valve to the third nozzle.

6. A shower head as claimed in claim 3 wherein the shower nozzle has at least two different sets of spray openings, the water connection means having a line leading to each set of spray openings from the control valve.

7. A shower head as claimed in claim 1 wherein the shower nozzle has at least two different sets of spray openings, the water connection means having a line in the arm leading to each set of spray openings, and control means on the arm for controlling the water supplied to each line from the shower pipe.

8. A shower head as claimed in claim 1 and further including a control valve in said water connection means, said control valve having an outer casing, a valve member rotatably mounted within the casing, an inlet in the casing, three outlets in the casing, the outlets spaced axially from the inlet but aligned with each other, one outlet extending radially from the casing in one direction, the other two outlets extending in opposite directions to the one outlet and parallel with the one outlet.

9. A shower head as claimed in claim 8 wherein the valve member has a base with an annular, cylindrical wall, a slot in the wall providing communication between the inlet and at least one of the outlets, the slot being wide enough to provide communication between the inlet and any two adjacent outlets when desired.

10. A shower head as claimed in claim 9 including seal means for sealing the slot off from those outlets it is not in communication with.

11. A shower head as claimed in claim 10 wherein the seal means has part circumferential grooves in the outer face of the wall of the base of the valve member below and in front of the slot and above and behind the slot; a longitudinal groove adjacent each side of the slot in the face of the wall joining the part circumferential grooves together, and a seal member shaped to fit within all the grooves to extend about the circumference of the wall.

12. A shower head having: a variable spray shower nozzle; the nozzle having at least two sets of spray openings for spraying different patterns of water; means in the shower head providing a separate supply of water to each set of spray openings in the nozzle; and control means in the shower head for controlling the water supply means to control which sets of spray openings are provided with water.

13. A shower head as claimed in claim 12 wherein the water supply means comprise a water line leading to each set of spray openings in the nozzle.

14. A shower head having: a main body; at least two sets of spray openings, for spraying different patterns of water, on the body of the head; a separate water inlet on the body for each set of spray openings; a separate water line leading to each water inlet on the body; a central chamber in the body for directing water form one water inlet to one set of spray openings; an annular chamber in the body, surrounding the central chamber, for directing water from the other water inlet to the other set of spray openings; and a spinner rotatably mounted in the annular chamber for pulsating water from the other set of spray openings.

15. A shower nozzle as claimed in claim 14 wherein the spinner has a flat annular section extending over about two thirds of the annular chamber, and spaced apart vanes extending transversely from the annular section.

16. A shower nozzle as claimed in claim 15 including a flow ring fixedly mounted within the annular chamber and dividing it into an inlet chamber and an outlet chamber, the spinner located in the outlet chamber, the flow ring having slanted passages therethrough for directing water from the inlet chamber into the outlet chamber at a shallow angle to impinge against the vanes of the spinner to rotate it within the annular body.

17. A shower nozzle as claimed in claim 16 wherein the flow ring has two slanted passages diametrically opposed to each other.

18. A shower nozzle as claimed in claim 16 including means on the body for directing water from the other water inlet into the inlet chamber in the direction of the slant of the passages.

* * * * *